United States Patent [19]

Carmon et al.

[11] 4,258,354

[45] Mar. 24, 1981

[54] PORTABLE ALARM DEVICE

[76] Inventors: Amiram Carmon, 35 Ruth St.; Yair Friedman, 12 Burca St., both of Haifa, Israel, 32000; Robert S. Savin, 1025 Nautilus La., Mamaroneck, N.Y. 10543

[21] Appl. No.: 38,321

[22] Filed: May 11, 1979

[51] Int. Cl.[3] ..... G08B 7/06

[52] U.S. Cl. ..... 340/309.4; 340/309.1; 221/2; 368/10

[58] Field of Search ..... 340/309.1, 309.4; 221/2; 368/10

[56] References Cited

U.S. PATENT DOCUMENTS

| | | | |
|---|---|---|---|
| 3,227,127 | 1/1966 | Gayle | 221/2 |
| 3,998,356 | 12/1976 | Christensen | 221/2 |
| 4,074,251 | 2/1978 | Creely | 340/309.1 |

*Primary Examiner*—Harold I. Pitts

*Attorney, Agent, or Firm*—Brumbaugh, Graves, Donohue & Raymond

[57] ABSTRACT

A portable alarm embodying a plurality of actuatable warning devices, a clock generator for generating time signals and a selector for receiving a plurality of the time signal outputs, each corresponding to different times, and utilizing the selected time signal outputs along with a stored activation schedule to actuate selected warning devices. In a preferred embodiment, the portable alarm contains medicine storage means and the actuatable warning devices are visual indicators which indicate a particular medicine to be taken.

18 Claims, 10 Drawing Figures

FIG. 2
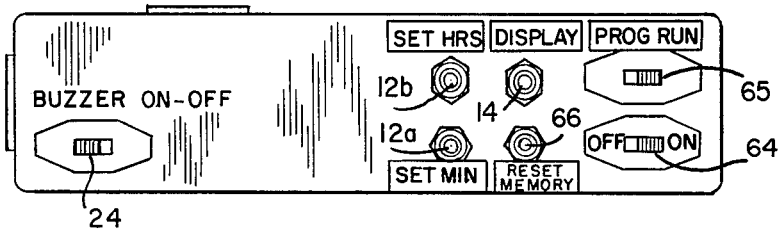
FIG. 1
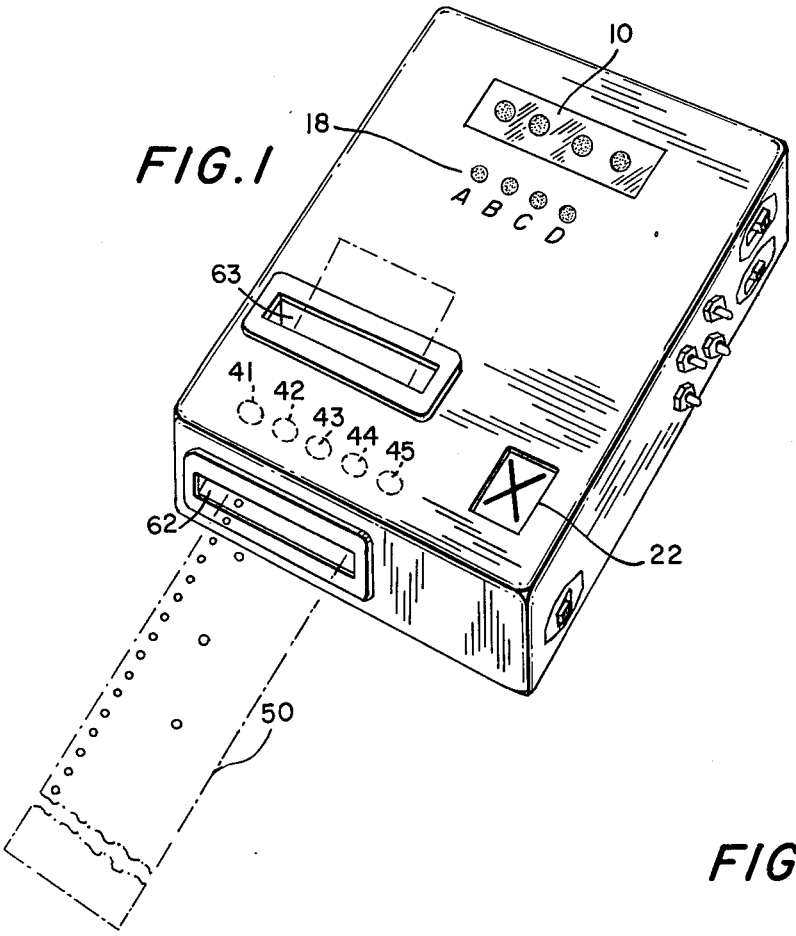
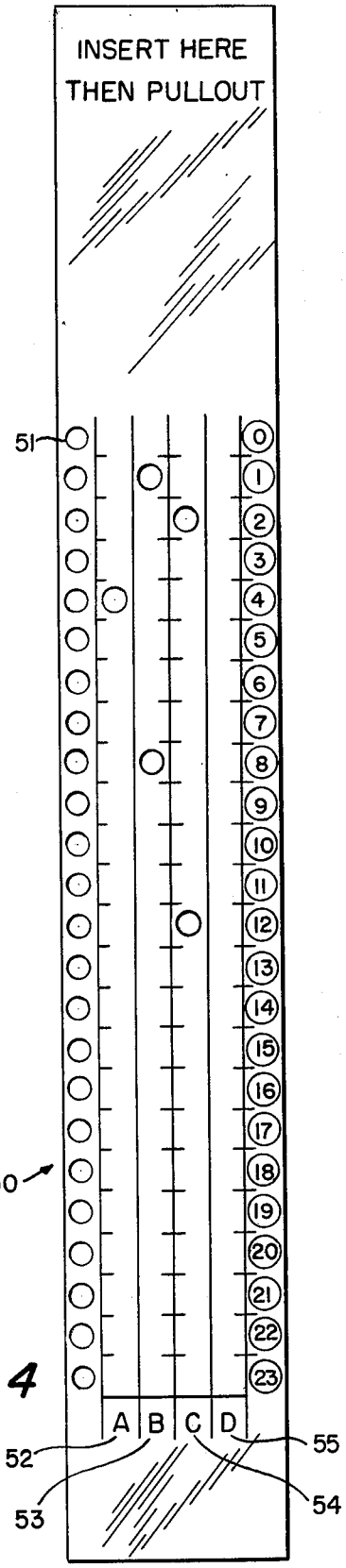
FIG. 4

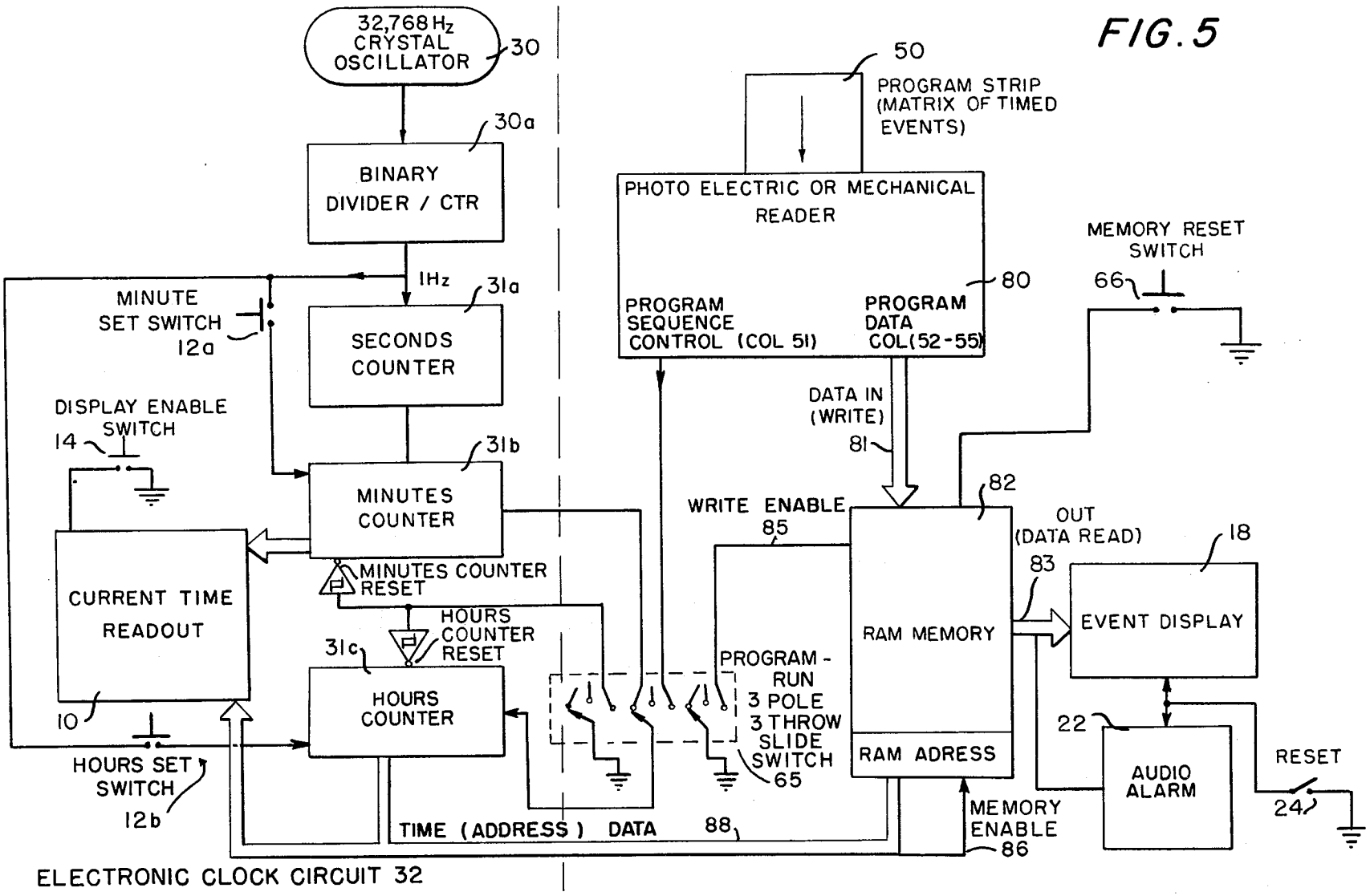
FIG. 5
PROGRAM STRIP (MATRIX OF TIMED EVENTS)
50
PHOTO ELECTRIC OR MECHANICAL READER
80
PROGRAM DATA COL(52-55)
PROGRAM SEQUENCE CONTROL (COL 51)
DATA IN (WRITE)
81
MEMORY RESET SWITCH
66
82
RAM MEMORY
RAM ADRESS
OUT (DATA READ)
83
EVENT DISPLAY
18
AUDIO ALARM
22
RESET
24
MEMORY ENABLE
86
WRITE ENABLE
85
PROGRAM - RUN 3 POLE 3 THROW SLIDE SWITCH
65
88
DATA
TIME (ADDRESS)
32,768 Hz CRYSTAL OSCILLATOR
30
30a
BINARY DIVIDER / CTR
1Hz
31a
SECONDS COUNTER
31b
MINUTES COUNTER
MINUTES COUNTER RESET
HOURS COUNTER RESET
HOURS COUNTER
31c
MINUTE SET SWITCH
12a
DISPLAY ENABLE SWITCH
14
CURRENT TIME READOUT
10
HOURS SET SWITCH
12b
ELECTRONIC CLOCK CIRCUIT 32

PORTABLE ALARM DEVICE

BACKGROUND OF THE INVENTION

This invention relates to a portable alarm device equipped with a plurality of warning indicators which can be identified by the user to give him preselected warnings at preselected times, e.g. indications when pills should be taken or tasks are to be performed.

People who have very busy schedules need reminders of their next appointment or task. In most cases this is accomplished with a diary or schedule which is written out by hand. A typical example of such a schedule is the ordinary desk calendar which has lines representing the hours of the day. However, this may be ineffective if the user is away from his desk or fails to check it at frequent intervals. Also, they are usually not portable. If a pocket note pad is used, there is a likelihood that it will not be referred to until after the time for an appointment has passed. In order to overcome some of these problems, alarm wrist watches have been made which will sound an audible alarm at a preset time; thus causing the wearer to refer to his note pad for an explanation of what action is due from him at that time. One difficulty with this arrangement, however, is that most watches can alarm at only one preset time. Therefore, the schedule for the entire day cannot be set at one time. Those watches capable of being actuated at more than one time are also deficient in that they do not permit the operation of multiple alarms distinctly associated with separate events, since each alarm is identical to the others in terms of the signal issued.

One use for multiple alarms associated with separate, distinct events is in connection with ambulatory patients. These patients, who are responsible for taking medication prescribed by their physicians, have a particular need for a portable device to warn them when one or more of a number of pills is to be taken. Such tasks can happen several times during a day, and each time one or more of several different drugs has to be consumed.

Pill dispensing devices which dispense pills at specific times have been heretofore proposed. For example, pill dispensing devices are described in U.S. Pat. Nos. 3,918,045 to Williams and 3,698,900 to Stambuck, in which timing disks activate mechanisms that dispense the proper medicine at the proper times. However, these devices are bulky and cannot be carried about by the patient. Also, the plurality of timing disks used with these mechanisms make it difficult to obtain an overview of the patient's medication schedule. A pill dispenser having a keyboard to program the allocation of drugs is also disclosed in U.S. Pat. No. 3,998,356 to Christensen. Here again, however, the device is necessarily located at a particular station and is not portable. U.S. Pat. No. 3,227,127 to Gayle discloses a portable mechanical device which indicates when the last pill has been taken, but it does not alert the user to the time when the next pill should be taken.

SUMMARY OF THE INVENTION

The present invention provides a pocket size alarm capable of providing any of a plurality of preselected indications or warnings at preselected times to the person carrying the device.

The warnings are preferably a plurality of visual indicators which enable, for example, the user to identify a particular medicine to be taken, but the indicators can also be associated with particular messages, events or tasks. Also, the plurality of visual indicators can be accompanied by a plurality of audio alarms, each associated with a different task.

In an illustrative embodiment of the invention used as a pill box, a pocket-size housing contains provisions for storing a variety of medicines. An opaque film strip with holes punched in it by the pharmacist or the user may be employed as a programming device for the unit. This film strip is read by a photoelectric reader within the medicine box and the information is stored in an internal memory. An internal clock is also provided in the housing and is connected to a display so that the person can read the time of day. The clock and the programming device work in conjunction with a time-event decoder which activates one or more of the plurality of the warning or indicating displays which are coded, e.g. as symbols or letters, to correspond to the medicine to be taken when a particular warning or indicator is activated. The time event decoder is also housed in the device. The display may be in the form of a liquid crystal unit that indicates the letters corresponding to the proper medicine, e.g. by means of a marker above the letter, and uses four digits to indicate the time of day.

The film strip used for programming may be attached to the medicine box to provide a record of the overall medication schedule since it is arranged with rows and columns to indicate the time and medication respectively. Instead of the film strip, the internal memory can also be programmed with a set of buttons, one for each medicine unit and one to advance the program to the next row. In this case, it is possible to review the total program by rapidly advancing the internal clock through 24 hours and reviewing what drugs are to be taken at each hour. The display will show, during the cycle, the total program as it is stored in the internal memory.

A microprocessor integrated circuit on a single chip may be used for the programming, timing, time-event decoding and displaying operations. In this case the microprocessor includes the clock, the internal memory used to store the program of the drug intake schedule, another memory which is designed to carry a special program for encoding and decoding the time-event matrix, and the necessary display drivers. Encoding of the program may be accomplished by connecting the buttons on the unit directly to the input of the integrated circuit. Decoding is done directly from the microprocessor to an alphanumerical display (e.g., a liquid crystal display) which has the ability to visually indicate both the time and the drug to be taken at that time. Furthermore, the decoding mechanism is programmed so as to sound an audible alarm whenever a visual indication to take a drug is given. In addition, it is possible to program the decoding mechanism so that a different audio alarm with be sounded in association with different drugs.

In a still further embodiment of the invention the indicators are associated with a plurality of tasks (e.g. meetings, phone calls, trips, etc.) which the user wants to be reminded to carry out. In this sense the device is like a portable electronic diary.

BRIEF DESCRIPTION OF THE DRAWINGS

The foregoing and other features of the present invention will be more readily apparent from the following detailed description and drawings of illustrative embodiments of the invention in which:

FIG. 1 is a front perspective view of a pocket-sized pill box that is programmed with a film strip;

FIG. 2 is a side view of the pill box of FIG. 1;

FIG. 4 is a view of the typical programming film strip used in conjunction with the pill box of FIG. 1;

FIG. 5 is a block diagram of the alarm circuitry of the pill box of FIG. 1;

DESCRIPTION OF EXEMPLARY EMBODIMENTS

Figure 3:
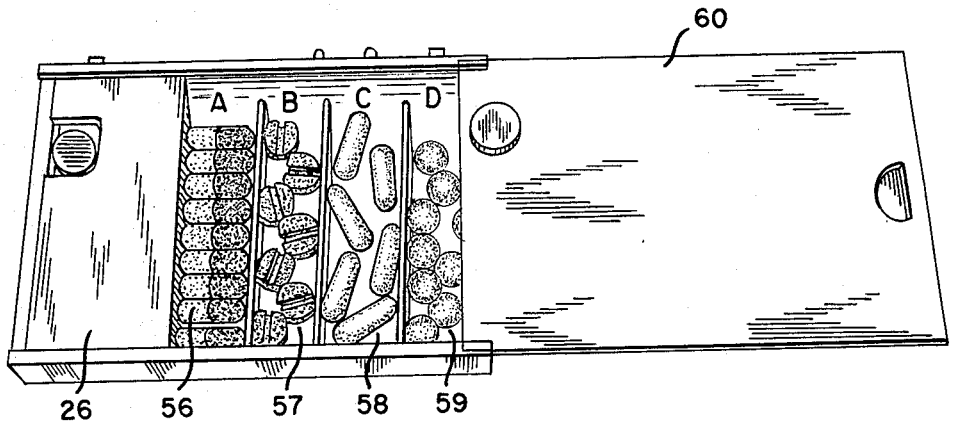
FIG. 3 is a rear view of the pill box of FIG. 1 with the rear cover removed.

A pocket-size pill box or case programmed by a film strip 50 is shown in FIGS. 1, 2 and 3. The pill case has an internal clock comprised of counters operated by a crystal oscillator that drive a time readout or display 10 that may be a liquid crystal display or a light emitting diode (LED) display such as those used on digital watches. The National Semiconductor LED numeric series are suitable for this purpose. The pill box also contains two switches 12 (FIG. 2) which are used to set the correct time in terms of hours and minutes, by advancing the hours and minutes of the clock with a 1 Hz pulse applied to these counters independently of the normal crystal oscillator drive. As long as these switches are activated the counters will advance at the rate of 1 Hz. A switch 14 is provided for activating the display 10. Since the pill case will usually be in the patient's pocket, it is not necessary for an LED display to be activated continuously. Therefore, the power of a battery that runs the electronics can be saved by displaying the time only when switch 14 is operated. A set of indicator displays 18, each with a different color or displaying a different symbol, are located on the front of the device. These displays 18 correspond to medicine holders that include compartments 56–59 located under the back cover of the pill case (FIG. 3). When the medicine case has been appropriately programmed, one or more of the indicator displays 18 will be activated when it is time for the patient to take some medication. The color or letter displayed indicates to the patient which medicine compartment contains the correct dosage of medicine to be taken. Normally the compartments will contain more than one day's supply of medicine. However, the medicine is to be prepared so that the patient is to take one capsule from the medicine compartment indicated by the indicator display 18. When different dosages of the same medicine are to be taken at different times, each dosage should be assigned to a different medicine compartment. Naturally the number of indicators and medicine compartments can be expanded to meet the needs of the patient and the invention is not limited to the four units illustrated.

Since the pill case will be in the patient's pocket, it is advantageous to have an audio alarm 22, e.g. a buzzer, to notify the patient that some medicine is to be taken. When the patient removes the pill case from his pocket he will see which indicators are activated and will know which medicine must be taken. Since the audio alarm is set to remain on for at least one minute, the annoyance of its sound can be eliminated by resetting it with a reset switch 24.

When a physician prescribed medicine for a patient, the prescription describes not only the medication to be taken, but the amount and the schedule on which it is to be taken. The prescription is read and interpreted by the pharmacist in filling the prescription. When the pill case of the present invention is used, it is contemplated that the pill case will be presented to the pharmacist, who will fill the medicine compartments with the correct medication and will program the pill case with the film strip 50 so as to indicate to the patient when he should take the medication. Alternatively, the patient or a family member can perform this operation. With this arrangement, it is advantageous if the programming device presents a visual picture of the overall schedule of medication so that the pharmacist can quickly and accurately check that the correct program has been entered into the pill case. Such visual indication of the overall schedule is also useful to the patient in planning his day so that he can anticipate medication periods. Both the programming and visual record functions are achieved with the pill case of FIGS. 1–3 by means of the film strip 50 which may be attached to the case at some convenient location after programming is completed. This is an advantage over the prior art which used a plurality of timing disks whose effects have to be combined mentally or physically to give a picture of the overall medication schedule.

The electronics for activating the indicators 18 and the audio alarm 22 are located beneath the back cover in area 26 illustrated in FIG. 3. Also in area 26 there is a battery for powering the device. These electronics, which are turned on by switch 64, are shown in detail in FIG. 5. The time signals for the electronics are generated in an electronic clock 32, similar to those used in digital clocks, which are either commercially available or can be assembled from a series of counter circuits 31. This clock 32 is driven by a quartz crystal oscillator 30 whose frequency is divided first to 1 Hz by a multi-stage counter/divider **30*a* which is commercially available. The binary coded decimal counters 31 count-down this 1 Hz frequency and generate the binary coded decimal time signals that are applied to the drivers of readout device 10. As was stated previously, display switch 14 must be operated in order for the time digits to be visable, if an LED display is used. The correct time is set in the clock by applying the 1 Hz frequency signal from circuit 30*a* via switches 12*a* and 12*b* to the minutes and hours counters 31*b* and 31*c* so that they rapidly advance to the correct time. The outputs of the hour counter 31*c* of the clock are also supplied to a memory circuit 82**.

Memory circuit 82 also receives inputs from a reader 80 capable of interpreting the programming film strip 50. The film strip 50 (FIG. 4) has a series of five columns and 24 rows. The first column 51 has holes at each of the 24 rows representing the hours and is used to generate a trigger signal for loading the information from the other columns. Each of the other columns (52–55) represents a compartment (56–59) of the pill box accessible by removing back cover 60 (FIG. 3). As stated above punching a hole in the appropriate column at the appropriate hour row, will code the film strip to indicate when and which medication is due. The film strip itself acts as a visual record of the overall medication schedule.

The holes in the film strip can be read by the mechanical reader or electro-optical reader 80, which devices are conventional in the art. To accomplish this the film strip is inserted into the slot 62 until it extends from slot 63 (FIG. 1). Then the electronics are set into a program mode by setting switch 65 to PROG (FIG. 2). This switch is a 3 pole-3 throw slide switch. When it is moved from the RUN to the PROG position it will reset the minutes and hours counters and will enable writing into the RAM 82 via write enable line 85. By pulling the film strip from slot 63 it is read into the pill box by the reader and the information is transmitted to and stored in the internal memory 82, which memory can be reset via a switch 66. The strip itself can then be attached to the pill box for handy reference. If switch 65 is set to RUN, the pill box will keep track of the time on readout 10 and will signal, via indicators 18 of the event display and the audio alarm 22, when it is time to take medication. The display is in the form of either light emitting diodes or a liquid crystal which, upon activation, display at least one of the symbols, e.g. letters, A, B, C and D, which correspond to the medicine compartment.

When the reader 80 is of the photoelectric type it contains phototransmissive assemblies, e.g. Texas Instruments TIL 138 units, one for each column of the film strip. These units include a light emitting diode and a photosensitive transistor separated by the film strip. Since the film strip is opaque the photosensitive transistor will receive light from the photodiode only when a hole is present in the film at a position between the diode and the transistor.

The medication schedule is sequentially read and electrically stored in the same sequence in memory 82, which may be a static random access memory (RAM) unit such as National Semiconductor model MM74C810. With this type circuit, data words may be stored or read from one of 64 memory locations, with four bits or memory for each word. The words are selected by a six bit address code. However, in this embodiment only 24 locations, corresponding to the 24 hours, are used. The activation of write enable line 85 determines whether or not a read or write operation is performed on the RAM. Toward this end, information from the film strip 50 is stored by placing the mode selector switch 65 in the PROG position. This generates a signal that activates the write enable line 85, preferably with a circuit having an output matched to the RAM. Then as the film strip is pulled past the reader 80, the holes in column 51 create electrical signals that are applied to the hours counter 31*c* via switch 65 and advance it. The output 88 of the hours counter is applied to the address control of the memory along with a memory enable signal 86 that is produced on the change of the hour. These signals cause the RAM to sequentially address the memory location specified by the hours counter. The proper address is selected because, it will be recalled, the switch 65 has reset the hours counter 31*c*. Therefore, as the holes in column 51 are detected by reader 80, counter 31*c* keeps track of the total number that have been sensed. Each hole in column 51 represents one hour, so the counter after being reset counts from 1 to 24, thereby generating the address signal 88 where the twenty-four hours of medication information are to be stored. Whenever a column 51 hole is detected the data representing the holes in the other columns of that row create signals 81 that are applied to the input of the RAM, where they are stored. Since counter 31*c* addresses the memory during programming and also during operation, there is no need to provide a complicated system to locate the address of information on the medication for any hour and thus it is not likely that a mistake will occur.

As a less expensive alternative, film strip 50 and the reader 80 can be replaced with push buttons 41–45 (shown in dotted line in FIG. 1) which correspond to the columns 51–55 on the film strip. Button 41 advances the counters of the program sequence control 84 and the buttons 42–45 supply the input signals 81 for insertion into RAM 82. By resetting the hour counter 31*c* with switch 65 and repeatedly pressing button 41, the RAM is addressed sequentially for 24 locations corresponding to a 24 hour period. After each depression of button 41, the buttons for the medication to be taken at that hour are depressed.

In operation the mode switch 65 is set to RUN. This disables the write enable line and the RAM will be in the read mode. The operation then changes over to the electronic clock 32, whose output now supplies the address signals 88, and the memory enable signal through line 86. At each hour change the new hour is strobed into the address latches of the RAM and the contents of that memory address, which is a four bit code representing the four pill compartments 56–59, appear on the output lines 83 of the RAM. This activates the event display unit 18 and sounds the audio alarm.

With the electronics shown in FIG. 5 the user can program the device to indicate the hour when any one or all of the medications in the compartments are to be taken. The film strip forms a visual record of the medication schedule set in the device. At the appropriate time an audio alarm will sound and an indicator will be activated to show the proper medication.

Figure 6:
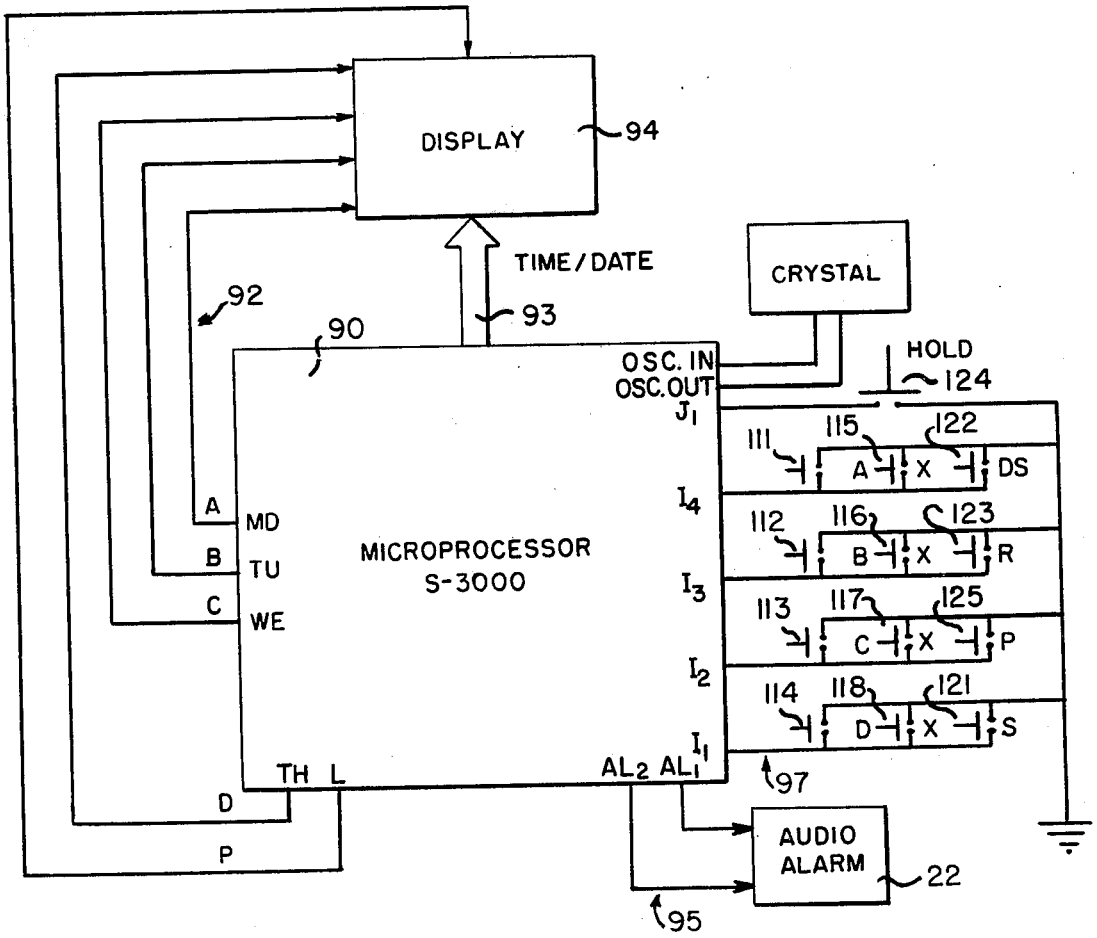
FIG. 6 is a block diagram of an alternative alarm circuit for the pill box of FIG. 1, based on a microprocessor.

Besides the circuit of FIG. 5 the electronics of the present invention can use single chip microprocessors, such as the S-3000 manufactured by Americal Microsystems, Inc. of Santa Clara, Calif. This microprocessor 90 is designed for electronic watches and has to be arranged as shown in FIG. 6 in order to operate with the present invention. The microprocessor contains a mask programmable read-only memory (ROM) that controls its operation. Therefore, it is necessary to program the operation, translate it into machine code and store it as a mask in the ROM in order for the microprocessor to perform the operations that the circuit of FIG. 5 performs. A sample program for this purpose, i.e. PD-01-M, is appended. This program was tested within the chip, and in a module combining a liquid crystal display and a piezo-cermic buzzer, and was found to perform the necessary functions for operation. Since this microprocessor has an internal clock, it is not necessary to have a separate external electronic watch, but the circuit must be supplied with a signal 91 from a 32,768 Hz oscillator.

Figure 7:
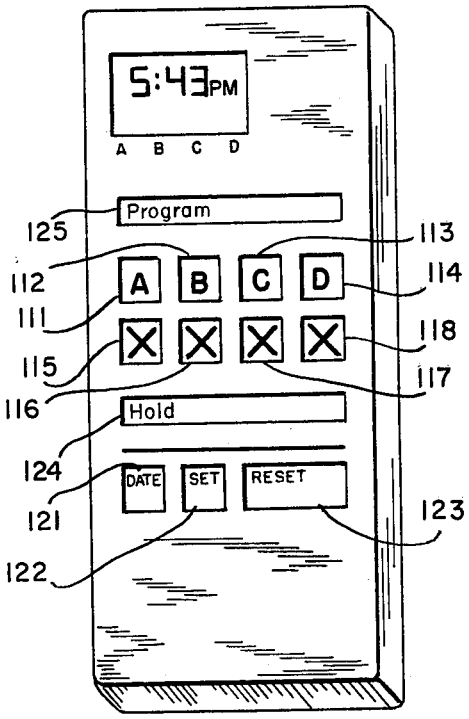
FIG. 7 is a front view of a device which includes a microprocessor, a set of switches to program it and a liquid crystal display which is used to indicate the hours and the various drugs to be taken.
Figure 8A:
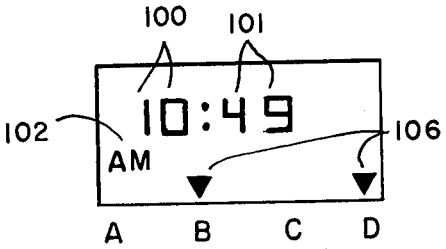
FIG. 8A and 8B are enlargements of the display of the device of FIG. 7 during operation and programming, respectively.
Figure 8B:
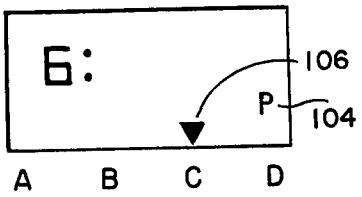

Output lines 93 of the microprocessor are used to drive a liquid crystal time/date display 94 such as that illustrated on the pill box of FIG. 7. The display, shown in more detail in FIGS. 8A and 8B has four seven-segment digits that show the time in terms of hours digits 100 and minute digits 101. These same digits may be used to display the seconds and date. Also, "AM" and "PM" symbols 102 and a "P" 104 for program are included. Lines 92 from microprocessor 90 activate the event indicators which in this case are the small pointing triangles 106 that point at letters A, B, C, D imprinted on the cover of the device just below the display. A piezo-ceramic buzzer (e.g. a Gulton CCAT 105 CFB) is driven by output lines 95 of the microprocessor. Programming data is entered via lines 97, which are connected to the programming buttons 111–118 of the pill box in FIG. 7. Each pair of set-reset programming buttons is uniquely associated with one of the pill compartments in the device, which compartments (not shown) are located under its back cover. Thus, the requirement to take a particular pill is programmed by pressing, during the programming sequence, the set programming push bottom (111–114) identified with the letter (i.e. A, B, C or D) that corresponds to the compartment containing the pill. In addition, a previously programmed pill indication for a compartment is eliminated by pushing the reset programming button (115–119) with the "X" on it that is located below the set button indicating the compartment. The set buttons 111–114 and the reset buttons 115–119 are connected directly to the microprocessor via specific inputs to anti-bounce flip-flops which are incorporated in the microprocessor.

The device of FIG. 7 also has a DATE-SEC button 121. Upon depressing this button once, the date and the month will be displayed instead of time, as with most electronic watches. Depressing this button a second time displays the seconds. SET button 122 is used in conjunction with button 121 to set the correct time and date into the watch microprocessor. Depressing the SET button will cause the digits of one unit of the date or time to flash. Then by pressing button 121 the digits are rapidly advanced until the correct value is reached. Button 122 is pushed again and the next unit of digits begins to flash and can be corrected with button 121. This procedure is continued until the correct month, date and time is indicated. While setting the time and indicating it, the AM or PM indicator is illuminated to show the segment of the 24 hour day that is being displayed by the digits. Button 123 on the device is a reset which will silence the audio alarm once it has been sounded.

In order to program the device of FIG. 7, a PROGRAM button 125 is depressed. This causes the display the change from that shown in FIG. 8A to that of FIG. 8B in which the program symbol 104 is illuminated. In this mode only the hour digits are displayed and they are automatically displayed sequentially for two seconds each. Once an hour indication is reached for which medication must be taken, a HOLD button 126 is held down. This prevents the sequence from continuing. Then the set programming button or buttons corresponding to the medicine compartment where the correct medicine is located for that hour, is depressed. This will cause an indicator 106 to appear over the letter for that compartment. If another compartment had previous been programmed for that hour or an error is made, the programmed indication can be removed by depressing the X button associated with that compartment, i.e. the X button immediately below the set programming button for that compartment. Upon completion of the programming for that hour the hold button is released and the sequencing through the hours continues. Each time an hour is reached where the program must be changed, the hold button 126 is depressed and the programming buttons are operated. When the sequence completes a 24 hour cycle, which takes 48 seconds when the program is not changed, the sequencing stops and the operation returns to the normal time mode. From FIG. 6 it can be seen taht the set and reset buttons for each compartment and one of the function buttons actually perform the same function, i.e. they place a ground on the I inputs of the microprocessor. The microprocessor interprets the intended operation from its internal program. Thus the programming buttons 111–118 and the function buttons 121–125 could be replaced with five buttons. The additional buttons that are employed are merely for the purpose of making the operation of the device easier to understand for the user and is a human engineering feature.

During operation of the device the microprocessor compares the current time to its alarm processor. Where the time corresponds to a selected time increment, e.g. an hour, for which an alarm has been programmed, the microprocessor sounds the audio alarm for six seconds and indicates the compartment or compartments containing the medication to be taken by displaying a triangle 106 over the letter or letters of the compartments. Once the medicine is taken the audio and visual alarm are reset with button 123. If the user forgets to reset the specific alarm for the hour, it will repeat itself after 15 minutes. It should be noted, however, that the reset button does not affect the memory, and therefore, in the next cycle, all of the alarms registered will sound again, and the medicine display will appear again. This is advantageous for time-event programs, which are repeated every day. However, it is possible to program the device in such a way that the reset button will erase the memory content, or that the memory content will be erased automatically after the full cycle is completed.

The program of events for the next 24 hours can be viewed by pressing the PRGRAM button 125 of the device. The time increments and selected events will then be displayed sequentially.

Through programming of the internal operation of the microprocessor, not is alarm program, the time segments can be changed, e.g. from every hour to every fifteen minutes. Thus, the present device is extremely flexible in that a number of alarms can be programmed over a variable time frame.

Figure 9:
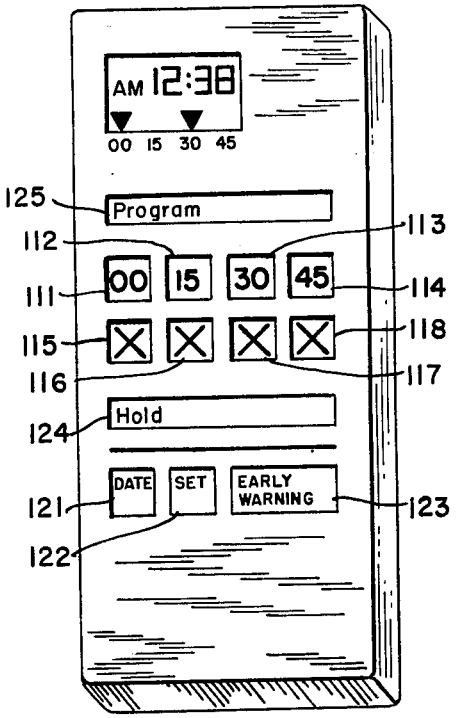
FIG. 9 is an embodiment of the device of FIG. 7 modified to function as a diary with multiple alarms during each hour.

If instead of medicines, messages concerning tasks or appointments were written in the compartments, it can be seen that the device of FIG. 7 also is useful as an electronic diary. As a result, the diary will have one of the four display indicators associated with specific types of tasks, such as travel, telephone calls, specific meetings, etc. at the discretion of the user. An alternative diary device can be created by changing the program and eliminating the pill compartments from the device of FIG. 7 so as to convert it into the credit-card-size diary of FIG. 9. With this arrangement the set buttons 111–114 indicate 15 minute segments of an hour, instead of message compartments A, B, C or D. Thus during programming an alarm is set for any one or more quarter hour segments. However, with this program, it is not possible to determine what must be done in this configuration and messages have to be written on an associated note pad. When used as a diary the reset button 123 has an early warning function in that it permits the diary to sound an audio alarm before the scheduled time. The alarm is then turned off. At the scheduled time, however, the alarm will sound again. It is evident that various combinations of timed events can be entertained by using different programs. The main limitation is the size of memory. The number of time segments used to address the memory, multiplied by the number of possible events to be represented at each such time, define the necessary memory size.

While the present invention has been particularly shown and described with reference to preferred embodiments thereof, it will be understood by those skilled in the art that various changes in form and details may be made therein without departing from the spirit and scope of the invention.

We claim:

1. A portable alarm for giving preselected warnings at preselected times comprising:

a clock generator for generating time signals;

means for translating said time signals into a plurality of selected time signal outputs each corresponding to different times;

a plurality of actuatable warning devices; and selector means for activating selected warning devices in response to one or more of the selected time signal outputs and an activation schedule stored in a memory means, said schedule including information on the selected time signal outputs and selected warning devices for each such time signal output.

2. A portable alarm as set forth in claim 1 in which the selector means schedule is in the form of a matrix with one axis corresponding to different times of day in the form of the time signal outputs and another axis corresponding to different actuatable warning devices so that selected time signal outputs can be associated with selected warning devices.

3. A portable alarm as set forth in claim 1 in which the warning devices includes a purality of visual display indicators.

4. A portable alarm as set forth in claim 1 including a purality of event compartments corresponding to the plurality of actuatable warning devices, each compartment being uniquely indicative of some action to be taken.

5. A portable alarm as set forth in claim 1 including means for deactivating the warning devices after a period of time.

6. A portable alarm as set forth in claim 1 in which said selector means includes a display of the schedule of preselected warnings and preselected times.

7. A portable alarm as set forth in claim 1 wherein said selector means comprises a reader for reading a tape containing the schedule of information regarding warning devices to be activated at different times of day, said tape conditioning the selector means to store the information in said memory means.

8. A portable medicine storage box for holding medication to be taken according to a predetermined schedule and for automatically indicating when and what medication is to be taken, comprising:

a clock generator means for generating signals indicative of time;

a plurality of medicine storage compartments;

a plurality of alarms for indicating that medication is to be taken, each alarm corresponding to a separate one of said medicine compartments and, upon activation, indicating that the medication in the corresponding compartment is to be taken;

selector means for producing a plurality of signals which indicate a medication schedule in terms of which particular selected medication is to be taken at certain selected times, said selector means including means for storing and displaying the medication schedule in the form of rows of selected medication for particular times; and means for activating the appropriate alarms in response to one or more of the signals from the clock generator and the selector means.

9. A medicine storage box as set forth in claim 8 wherein the clock generator means includes a read out device for displaying the current time as determined by the clock generator.

10. A medicine storage box as set forth in claim 8 wherein the alarms include a plurality of colored lamps color-coded to correspond to the medicine storage compartments.

11. A medicine storage box as set forth in claim 9 wherein the read out device indicates alphanumeric characters as the alarm, which characters correspond to labels on the storage compartments.

12. A medicine storage box as set forth in claim 8 wherein the selector means comprises a thin material strip containing a column of holes representing time, space being provided adjacent each of the holes of selectively forming a plurality of additional columns of holes representing the medicine compartments, a reader means for reading the location of the holes in the strip and generating electrical signals in response thereto, and an address directed storage means for storing the electrical signals from the reader means at addresses corresponding to the holes representing time.

13. A medicine storage box as set forth in claim 8 including means for deactivating the alarms after a period of time.

14. A medicine storage box as set forth in claim 8 wherein the alarms include visual alarms correpsonding to the medicine compartments and an audio alarm that is activated whenever any of the visual alarms are activated, and including means for deactivating the audio alarm after a period of time.

15. A medicine storage box as set forth in claim 12 wherein the activating means is a time-event decoder which includes means for reading out the electrical signals from the storage means in response to the signals from the clock generator, which signals are indicative of the contents at the address in the storage means whose contents are to be read.

16. A portable alarm as set forth in claim 1 wherein the clock generator, means for translating and selector means are formed from a suitable programmed microprocessor driven by a crystal oscillator.

17. A protable alarm as set forth in claim 16 wherein the microprocessor is programmed by a set of selector buttons associated with the warning devices and forming a part of said selector means, one of said buttons initiating a programming sequence in which each of said different times is displayed for a period of time on a display device until all of the selected different times are displayed, during said period that the time is displayed the activation of other ones of said buttons causes the associated alarm to be programmed for activation at the displayed time.

18. A portable alarm as set forth in claim 17 wherein the device is a diary and the warning devices are associated with separate time segments between the different times.

* * * * *

UNITED STATES PATENT AND TRADEMARK OFFICE

CERTIFICATE OF CORRECTION

PATENT NO. : 4,258,354

DATED : March 24, 1981

INVENTOR(S) : Amiram Carmon, Yair Friedman and Robert S. Savin

It is certified that error appears in the above—identified patent and that said Letters Patent is hereby corrected as shown below:

Column 2, line 58, "with" (first occurrence) should read --will--;

Column 4, line 10, "prescribed" should read --prescribes--;

Column 5, line 44, "or" should read --of--;

Column 6, line 44, "Americal" should read --American--;

Column 6, line 57, "piezo-cermic" should read --piezo-ceramic--;

Column 7, line 49, "the" should read --to--;

Column 8, line 6, "taht" should read --that-;

Column 8, line 39, "PRGRM" should read --PROGRAM--;

Column 8, line 43, "is" should read --its--;

Column 10, line 37, "correpsonding" should read --corresponding--;

UNITED STATES PATENT AND TRADEMARK OFFICE

CERTIFICATE OF CORRECTION

PATENT NO. : 4,258,354 Page 2 of 2

DATED : March 24, 1981

INVENTOR(S) : Amiram Carmon, Yair Firedman and Robert S. Savin

It is certified that error appears in the above—identified patent and that said Letters Patent is hereby corrected as shown below:

Column 10, line 53, "protable" should read --portable--.

Signed and Sealed this

*Twenty-first* Day of *July 1981*

[SEAL]

*Attest:*

GERALD J. MOSSINGHOFF

*Attesting Officer* *Commissioner of Patents and Trademarks*